US005367725A

United States Patent [19]

Tsai

[11] Patent Number: 5,367,725

[45] Date of Patent: Nov. 29, 1994

[54] PLAYPEN STRUCTURE

[76] Inventor: Tsai-Lin Tsai, No. 179, San Kuan Rd., 17 Lin, Hsin Hsing Li, Tainan City, Taiwan, Prov. of China

[21] Appl. No.: 207,270

[22] Filed: Mar. 7, 1994

[51] Int. Cl.[5] ..... A47D 7/00

[52] U.S. Cl. ..... 5/99.1; 5/98.1

[58] Field of Search ..... 5/99.1, 98.1, 98.2, 5/98.3, 115, 310, 282.1

[56] References Cited

U.S. PATENT DOCUMENTS

| | | | |
|---|---|---|---|
| 244,217 | 7/1881 | Fenner | 5/99.1 |
| 826,590 | 7/1906 | Miller | 5/115 |
| 2,646,577 | 7/1953 | Thayer | 5/98.1 |
| 2,922,169 | 1/1960 | Werner | 5/99.1 |
| 4,008,499 | 2/1977 | Wren | 5/99.1 |
| 5,228,154 | 7/1993 | Brevi | 5/98.1 |
| 5,279,006 | 1/1994 | Teng | 5/99.1 |

*Primary Examiner*—Flemming Saether
*Attorney, Agent, or Firm*—McCubbrey, Bartels & Ward

[57] ABSTRACT

A playpen structure which has a fold base which has first and second X-shaped joint/foot elements, first and second V-shaped joint/foot elements, four long bars and four short bars. Each X-shaped joint/foot element has a foot and first, second, third and fourth arms radially projecting from the foot. The first and second long bars are pivotally linked to the first and second arms of the first X-shaped joint/foot element. The third and fourth long bars are pivotally linked to third and fourth arms of the second X-shaped joint/foot element. The first and second short bars are pivotally linked to the fourth and third arms of the first X-shaped joint/foot element. The third and fourth short bars are pivotally linked to the second and first arms of the second X-shaped joint/foot element. Each V-shaped joint/foot element has a foot and first and second arms radially projecting from the foot. The first short bar is pivotally linked to the first arm of the first V-shaped joint/foot element. The second short bar is pivotally linked to the first arm of the second V-shaped joint/foot element. The third short bar is pivotally linked to the second arm of the second V-shaped joint/foot element. The fourth short bar is pivotally linked to the second arm of the first V-shaped joint/foot element. Thus, there are three more feet provided in the present invention than in prior art.

8 Claims, 4 Drawing Sheets

PLAYPEN STRUCTURE

BACKGROUND OF INVENTION

The present invention relates to a playpen structure.

There have been various playpens which permit the children a degree of movement in play but restrain them from moving out of a safe area. Some of them employ rigid structures. Rigid playpen structures are strong, however, they occupy large space when they are not in use, as they are not foldable. There are some playpens with foldable structures. A conventional foldable playpen structure has an x-shaped base which consists of an X-shaped joint/foot element and four bars. The joint-/foot element has a foot which supports a floor and a joint to which the four bars are pivotally linked. Playpens with conventional foldable structures occupy small space when they are not in use; However, as only a foot is arranged at the middle of the base, the base might easily sink when children play on the floor. Therefore, there is a long unfulfilled need for a space-economic and strong playpen structure.

SUMMARY OF INVENTION

It is the primary object of the present invention to provide a space-economic and strong playpen structure.

The primary object of the present invention is achieved by providing a playpen structure which has a fold base which has first and second X-shaped joint-/foot elements, first and second V-shaped joint/foot elements, four long bars and four short bars. Each X-shaped joint/foot element has a foot and first, second, third and fourth arms radially projecting from the foot. The first and second long bars are pivotally linked to the first and second arms of the first X-shaped joint/foot element. The third and fourth long bars are pivotally linked to third and fourth arms of the second X-shaped joint/foot element. The first and second short bars are pivotally linked to the fourth and third arms of the first X-shaped joint/foot element. The third and fourth short bars are pivotally linked to the second and first arms of the second X-shaped joint/foot element. Each V-shaped joint/foot element has a foot and first and second arms radially projecting from the foot. The first short bar is pivotally linked to the first arm of the first V-shaped joint/foot element. The second short bar is pivotally linked to the first arm of the second V-shaped joint/foot element. The third short bar is pivotally linked to the second arm of the second V-shaped joint-/foot element. The fourth short bar is pivotally linked to the second arm of the first V-shaped joint/foot element. Thus, there are three more feet provided in the present invention than in prior art. Each arm of each X-shaped joint/foot element is shaped as an inverted "U" in a view taken in a longitudinal direction in order to receive a bar. Each arm of each V-shaped joint/foot element is shaped as a "U" in a view taken in a longitudinal direction in order to receive a bar.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
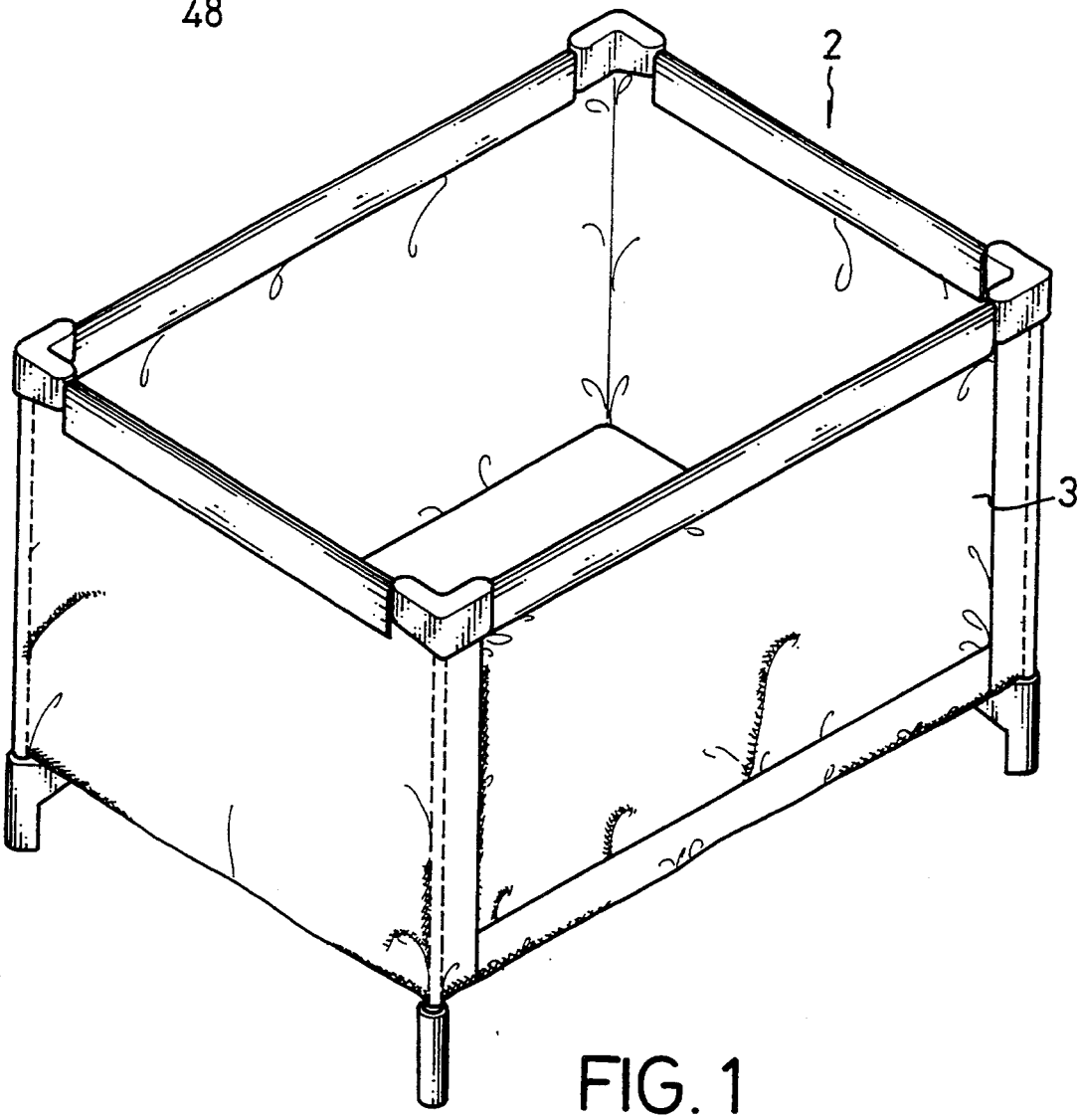
FIG. 1 is a front-left-top isometric view of a playpen in accordance with the preferred embodiment of the present invention.

Referring to FIG. 1, a playpen 2 has a plastic enclosure 3 which is supported by means of a structure 4 which has a base 5 (see FIGS. 2 and 3), a rail unit and a column unit which is connected between the base 6 and the rail unit. The rail unit includes two short foldable rails 7 and two long foldable rails 8. Each short foldable rail 7 consists of a joint 9 and two tubes (not numbered) which are pivotally joined together by means of the joint 9. Each long foldable rail 8 consists of a joint 9 and two tubes (not numbered) which are pivotally joined together by means of the joint 9. The column unit includes four columns 10. Each short foldable rail 7, a corresponding long foldable rail 8 and a corresponding column 10 are joined together by means of a joint 12. The rail unit is thus joined together with the column unit. Further details of the joints 12 will not be given as they are well known. The joints 9 will be further described later with reference to FIGS. 5 and 6.

Figure 2:
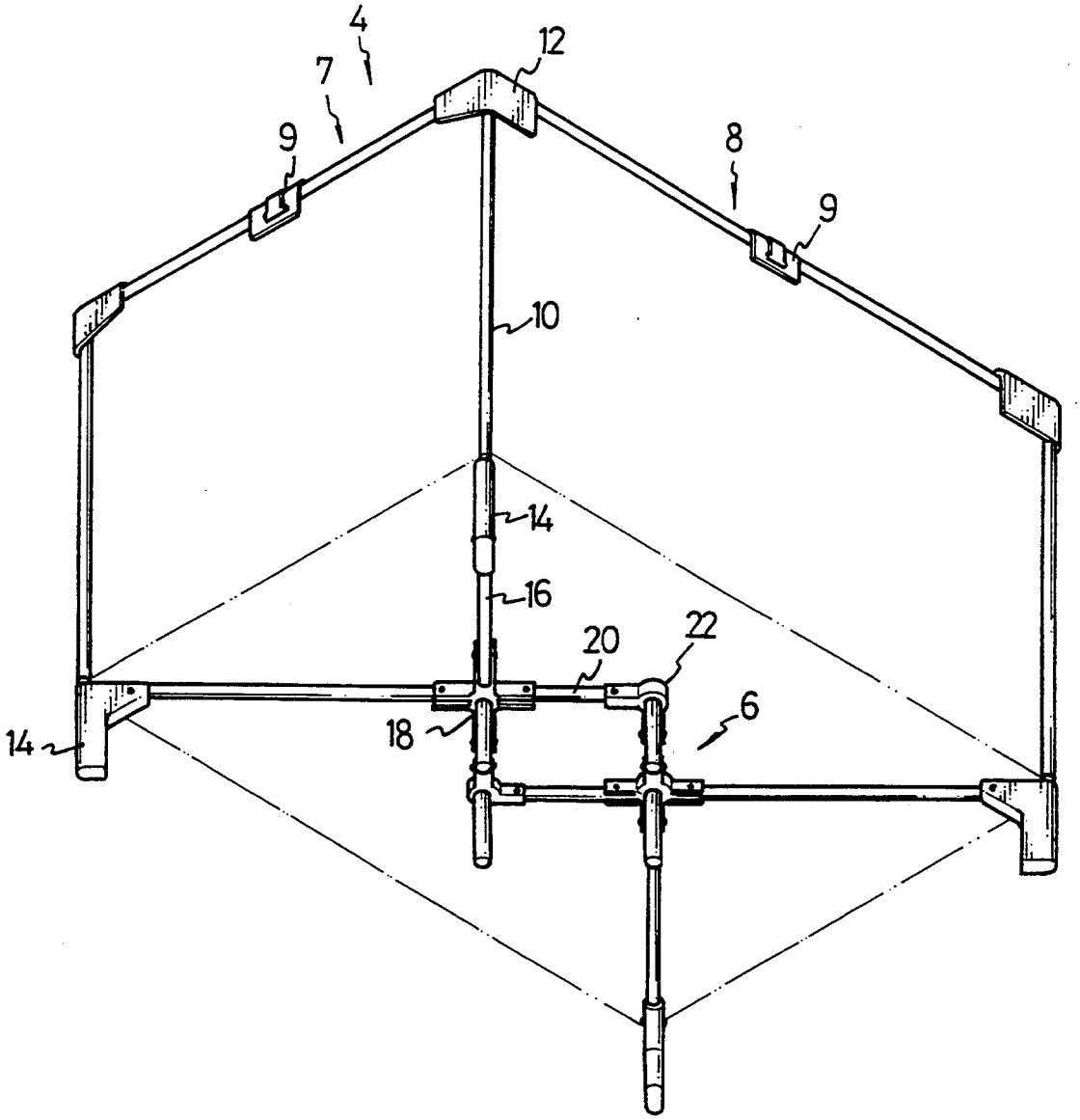
FIG. 2 is a front-right-bottom isometric view of the playpen shown in FIG. 1.

Referring to FIG. 2, the base 6 has four joint/foot elements 14, four long bars 16, two X-shaped joint/foot elements 18, four short bars 20 and two V-shaped joint-/foot elements 22. Each joint/foot element 14 has a foot and an arm projecting transversely from the foot thereof. Each column 10 is connected with the foot of a corresponding joint/foot element 14. Each long bar 16 is pivotally linked by means of a rivet (not numbered) to the arm of a corresponding joint/foot element 14. Thus, the column unit is joined together with the base 6. The joint/foot elements 14 will not be further described as they are well known.

Each X-shaped joint/foot element 18 has a foot and first, second, third and fourth arms radially projecting from the foot thereof. Each arm of each X-shaped joint-/foot element 18 is formed as an inverted "U" in a view which is taken in a longitudinal direction thereof in order to receive a long bar 16 or a short bar 20. The first long bar 16 is pivotally linked by means of a rivet to the first arm of the first X-shaped joint/foot element 18. The second long bar 16 is pivotally linked by means of a rivet to the second arm of the first X-shaped joint/foot element 18. The third long bar 16 is pivotally linked by means of a rivet to the first arm of the second X-shaped joint/foot element 18. The fourth long bar 16 is pivotally linked by means of a rivet to the second arm of the second X-shaped joint/foot element 18.

Each V-shaped joint/foot element 22 has a foot and first and second arms radially projecting from the foot thereof. Each arm of each V-shaped joint/foot element 22 is formed as a "U" in a view which is taken in a longitudinal direction thereof in order to receive a long bar 16 or a short bar 20. The first short bar 20 is pivotally linked by means of a rivet to the first arm of the first V-shaped joint/foot element 22. The second short bar 20 is pivotally linked by means of a rivet to the second arm of the first V-shaped joint/foot element 22. The third short bar 20 is pivotally linked by means of a rivet to the first arm of the second V-shaped joint/foot element 22. The fourth short bar 20 is pivotally linked by means of a rivet to the second arm of the second V-shaped joint/foot element 22.

Figure 3:
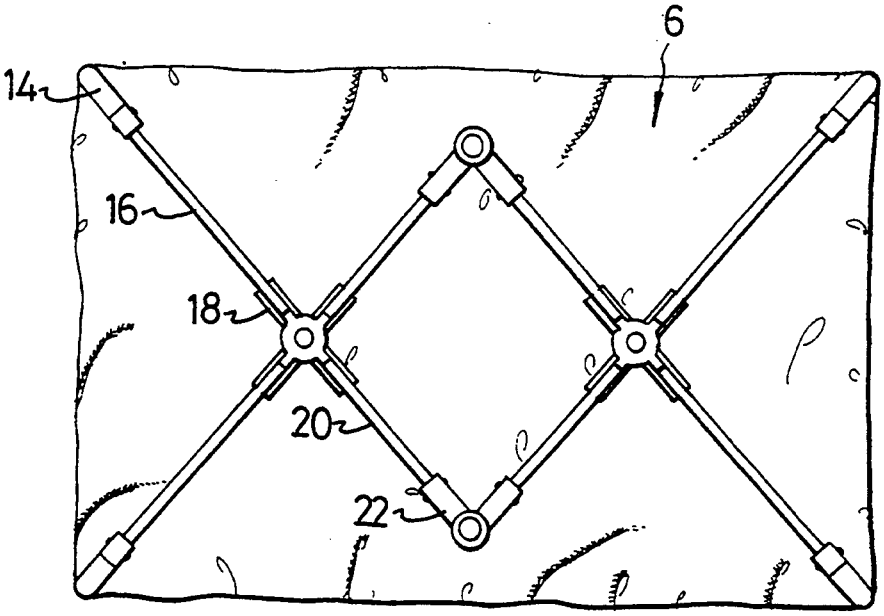
FIG. 3 is a bottom view of the playpen shown in FIG. 1.

Referring to FIG. 3, the four joint/foot elements 14 together provide four feet, and the two X-shaped joint-/foot elements 18 together provide two feet, and the two V-shaped joint/foot elements 22 together provide two feet. That is, the base 6 provides eight feet in total. A conventional foldable playpen uses a X-shaped base which provides only five feet. The number of the feet of the present invention is greater than the number of the feet of the conventional playpen. The base 6 is better supported by eight feet than the conventional X-shaped base is supported by five feet. The positions of the joint-/foot elements 18 and 22 should be determined so in order evenly support the base 6.

Figure 4:
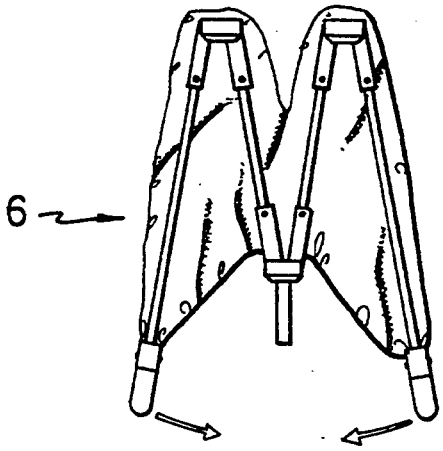
FIG. 4 is a front view of the playpen shown in FIG. 1, but showing the playpen in a folded position.

Referring to FIG. 4, the base 6 can be folded so that the playpen structure 4 can be stored easily.

Figure 6:
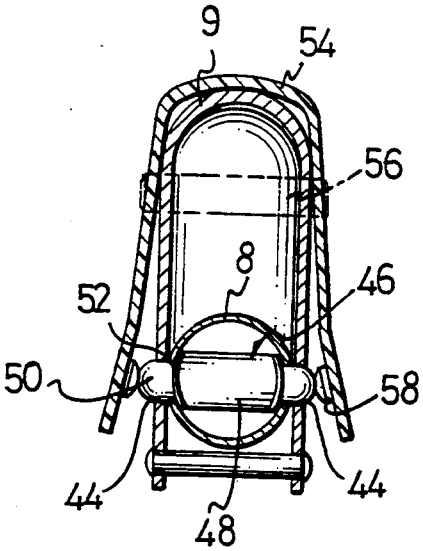
FIG. 6 is a cross-sectional view taken along a line 6—6 in FIG. 5.
Figure 5:
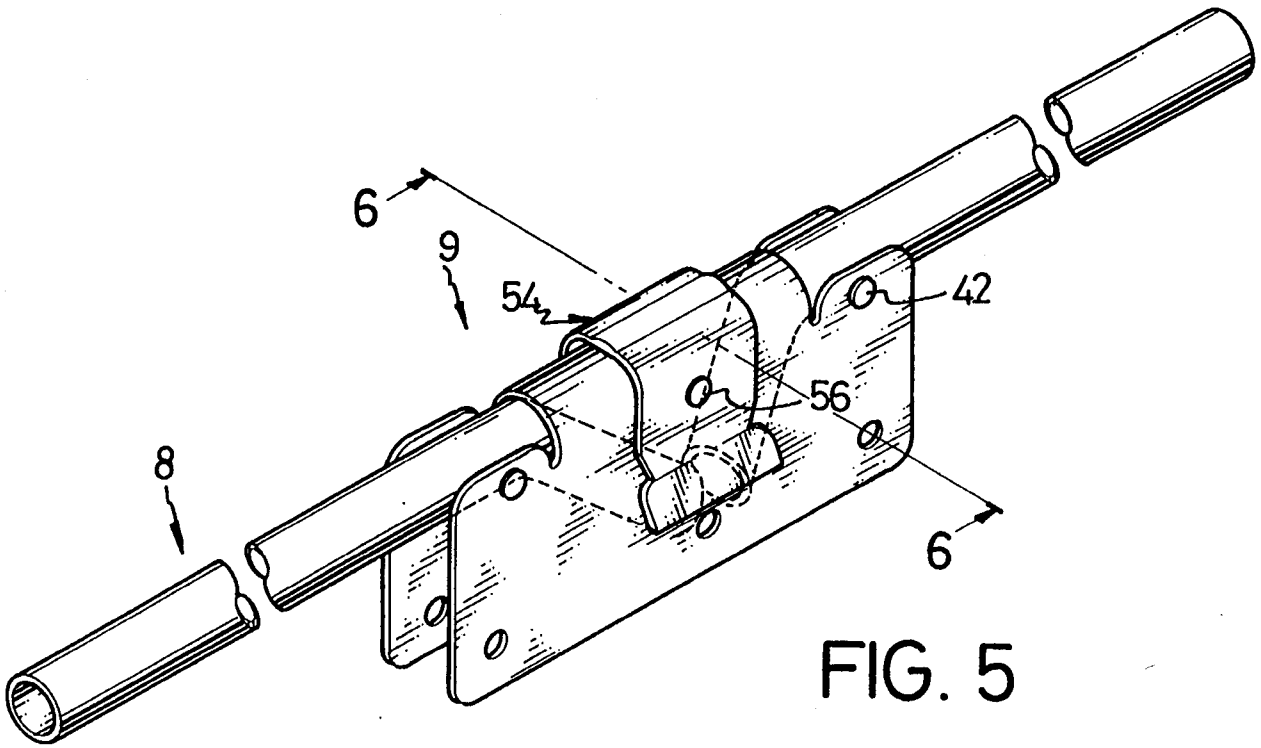
FIG. 5 is a front-left-top isometric view of a joint in accordance with the preferred embodiment of the present invention.

Referring to FIGS. 5 and 6, each foldable rail 7 or 8 has two tubes each with a curved end. The curved ends of the tubes of each foldable rail 7 or 8 are pivotally linked to each other by means of a joint 9. Each joint 9 is a curved metal strip so as to form two side plates. The edges of the side plates of each joint 9 are attached to each other by means of three rivets (not numbered) in order to retain each joint 9 in its desired shape.

Each tube of each foldable rail 7 or 8 is pivotally linked to the joint 9 by means of a rivet 42. Each side plate of each joint 9 defines two apertures 44 (only one is shown in FIG. 6).

Referring to FIG. 6, a spring-biased locking element 46 is received in an end of each tube of a foldable rail 7 or 8 which is hollow. The spring-biased locking element 46 consists of a curved leaf spring 48 and two latches 50 each of which is formed at a corresponding end of the curved leaf spring 48. The curved leaf spring 48 is attached in the end of the tube of the foldable rail 7 or 8. The latches 50 are biased by means of the curved leaf spring 48 into two holes 52 which are defined through the end of the foldable rail 7 or 8. The latches 50 are biased by means of the curved leaf spring 48 further into two apertures 44. Thus, the two tubes of each foldable rail 7 or 8 are kept from pivoting relative to each other.

Conventionally, the latches 50 are disengaged from the apertures 44 directly by means of users' fingers in order to fold each foldable rail 7 or 8. However, it is dangerous for users to put their fingers in the apertures 44. Such a danger is obviated by providing a press element 54 which will be described later.

The press element 54 is made from plastic. The press element 54 is a curved plastic strip which is mounted on the joint 9. The press element 54 is attached to the joint 9 by means of a rivet 56. Two bosses 58 each transversely project from a corresponding end of each press element 54 toward each other. The bosses 58 align with the apertures 44. Thus, the latches 50 can be disengaged by means of the bosses 58 from the apertures 44 by pressing the ends of the press element 54.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A playpen structure comprising a base, a rail unit and a column unit connected between the base and the rail unit, wherein the base comprises:

first and second X-shaped joint/foot elements each comprising a foot and first, second, third and fourth arms radially projecting from the foot;

first and second V-shaped joint/foot elements each comprising a foot and first and second arms radially projecting from the foot;

a first long bar being pivotally linked to the first arm of the first X-shaped joint/foot element;

a second long bars being pivotally linked to the second arm of the first X-shaped joint/foot element;

a third long bar being pivotally linked to the third arm of the second X-shaped joint/foot element;

a fourth long bar being pivotally linked to the fourth arm of the second X-shaped joint/foot element;

a first short bar for pivotally connecting the fourth arm of the first x-shaped joint/foot element with the first arm of the first V-shaped joint/foot element;

a second short bar for pivotally connecting the third arm of the first x-shaped joint/foot element with the first arm of the second V-shaped joint/foot element;

a third short bar for pivotally connecting the second arm of the second x-shaped joint/foot element with the second arm of the second V-shaped joint/foot element;

a fourth short bar for pivotally connecting the first arm of the second x-shaped joint/foot element with the second arm of the first V-shaped joint/foot element.

2. A playpen structure in accordance with claim 1 wherein each arm of each X-shaped joint/foot element is shaped as an inverted "U" in a view taken in a longitudinal direction in order to receive a corresponding bar.

3. A playpen structure in accordance with claim 1 wherein each arm of each V-shaped joint/foot element is shaped as a "U" in a view taken in a longitudinal direction in order to receive a corresponding bar.

4. A playpen structure in accordance with claim 1 wherein the rail unit comprises four foldable rails.

5. A playpen structure in accordance with claim 4 wherein each foldable rail comprises two tubes each comprising a curved end pivotally linked to each other by means of a joint which is a curved metal strip.

6. A playpen structure in accordance with claim 5 comprising a spring-biased locking device which is disposed in the curved end of each tube of each foldable rail for retaining the curved end of each tube of each foldable rail in position relative to the joint.

7. A playpen structure in accordance with claim 6 wherein the spring-biased locking comprises a curved leaf spring and two latches transversely projecting from two ends of the curved leaf spring whereby the latches are insertable through the curved end of each tube of each foldable rail and are further insertable through the joint.

8. A playpen structure in accordance with claim 6 comprising a press element which is a curved plastic strip, and which is mounted on the joint, and which comprises two bosses transversely projecting from two ends, so that the latches of the spring-biased locking device are disengaged from the joint by means of the bosses of the press element by pressing the press element.

* * * * *